United States Patent [19]

LeBreton

[11] 4,046,368

[45] Sept. 6, 1977

[54] FOUR PAGE BOOKLET

[76] Inventor: Jack G. LeBreton, 83 DeNesbbi Drive, Streetsville, Canada

[21] Appl. No.: 606,577

[22] Filed: Aug. 21, 1975

[51] Int. Cl.[2] ..... B65H 45/00

[52] U.S. Cl. ..... 270/61 R; 40/102; 40/124.1

[58] Field of Search ..... 270/1, 20, 21, 61; 40/124.1, 310, 5, 312, 1 L, 6 T, 28 R, 72, 73.2, 78.11, 102, 126.1, 104.08; 281/47–49, 23, 5; 283/34

[56] References Cited

U.S. PATENT DOCUMENTS

| | | | |
|---|---|---|---|
| 1,751,752 | 3/1930 | Osterlind | 270/1 |
| 2,453,902 | 11/1948 | Graham | 40/124.1 |
| 2,860,439 | 11/1958 | Johnson | 40/124.1 |

*Primary Examiner*—Ernest T. Wright, Jr.
*Assistant Examiner*—A. Heinz

[57] ABSTRACT

A four page booklet formed from a singular rectangular sheet having three vertical score lines. A center cut is made on the third vertical score line as well as two horizontal cuts back to the first vertical score line. The resulting flap is folded behind the first vertical row and over the front of the first vertical row. The free end of the flap is joined to the cut edge of the fourth vertical row.

1 Claim, 7 Drawing Figures

FOUR PAGE BOOKLET

SUMMARY OF THE INVENTION

My invention relates to a unique and novel concept of a printed booklet, wherein a rectangular sheet can be folded in and out on a plurality of vertical score lines to form four pages of printed material. In use, it can be easily carried in the user's book but carries two more pages of printed material than a conventional two side card.

Briefly, my present invention comprises a singular rectangular sheet having three vertical score lines. A center cut is made on the third vertical score line as well as two joining horizontal cuts back to the first vertical score line. The resulting center flap is folded behind the first vertical row and over the front of the first vertical row. The free end of the flap is joined to the cut edge of the fourth vertical row.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
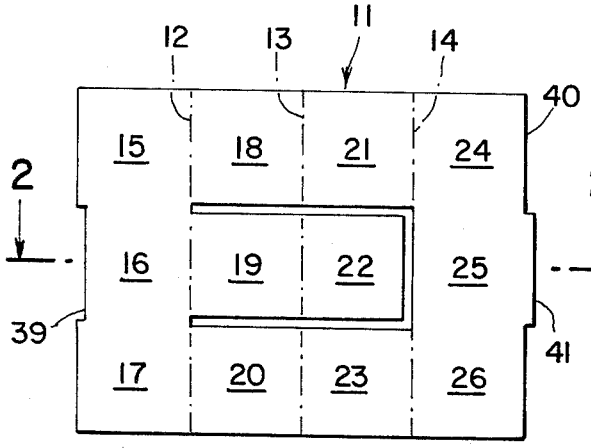
FIG. 1 illustrates a top view of the unformed rectangular sheet.
Figure 1A:
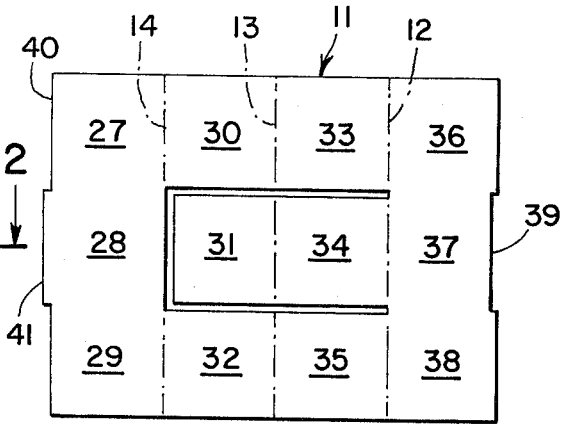
FIG. 1A illustrates a bottom view of the unformed rectangular sheet.
Figure 3:
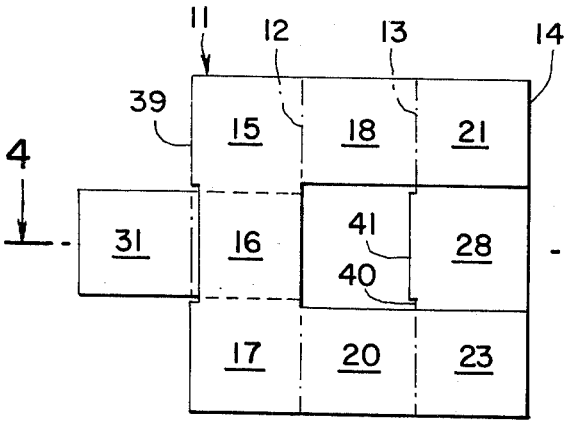
FIG. 3 illustrates a top view of the rectangular sheet, wherein the center flap is partially folded.
Figure 2:
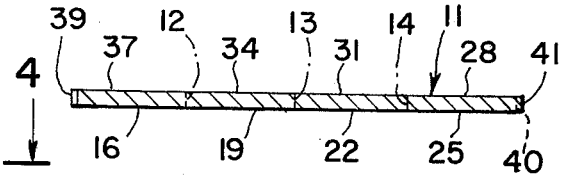
FIG. 2 illustrates a section view of the unformed rectangular sheet through line 2—2 of FIG. 1.
Figure 4:
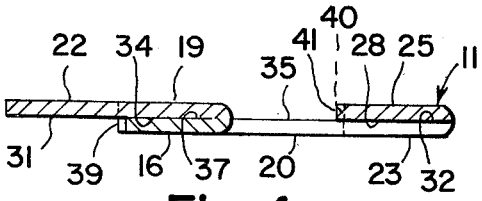
FIG. 4 illustrates a section view of the rectangular sheet, wherein the center flap is partially formed through line 4—4 of FIG. 3.
Figure 5:
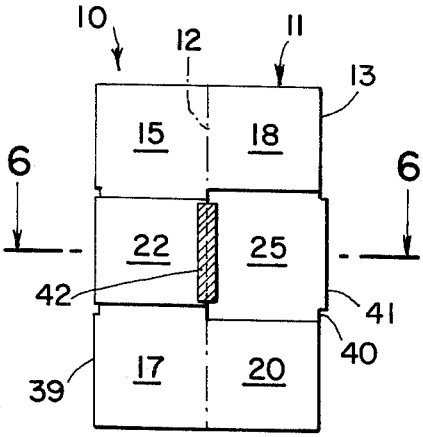
FIG. 5 illustrates a top view of the formed four page booklet.
Figure 6:
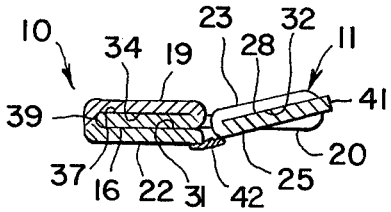
FIG. 6 illustrates a section view of the formed four page booklet through line 6—6 of FIG. 5.

Turning now descriptively to the drawings, in which similar reference characters denote similar elements throughout the serveral views, FIG. 5 shows a four page stationary booklet 10 formed from a single rectangular member 11 as shown in FIGS. 1, 1A. The booklet has a vertical score line 12, 13, 14, wherein by inter-vertical folding and opening along the score lines, four printed pages can be exposed. The booklet is formed as shown in FIGS. 1, 3, 5. The rectangular member 11 having three vertical score lines 12, 13, 14 is subdivided into twelve squares of four vertical rows as shown and labelled in FIG. 1. The reverse side of member 11 is also divided into twelve squares of four vertical rows as shown and labelled. As shown in FIG. 1, the left center vertical margin 39 is recessed corresponding to the edge of square 16. The right center vertical margin 40 has a flange 41 along the edge of square 25. The third vertical fold line 14 between squares 22, 25 is cut. A horizontal cut is made between squares 18, 21 and 19, 22 as well as between squares 19, 22 and 29, 23, wherein the resulting two squares flap 19, 22 is joined to square 16 by the first fold line 12. The flap 19, 22 is folded as shown in FIGS. 3, 4, wherein square 34 lays on square 37 as square 31 lays next to square 16. Square 31 is folded over to lay on square 16. Member 11 is folded along the third score line 14, wherein square 27 lays on square 30 and square 29 lays on square 32. The member 11 is next folded along the second score line 13, wherein square 24 lays on square 33 and square 26 lays on square 35. The free edges of squares 21, 25 are joined together by tape 42 as shown in FIGS. 5, 6. The four pages are formed from the following squares by interfolding and opening along the score lines 12, 13, 14.

a. page one-squares 15, 17, 18, 20, 22, 25
b. page two-squares 19, 21, 23, 28, 36, 28
c. page three-squares 16, 23, 24, 30, 33, 38
d. page four-squares 27, 29, 30, 32, 34, 37

Hence, obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A four page booklet formed from the following steps, which comprises:

a. forming first second and third vertical fold lines in a rectangularly shaped planar member having a front face and back face.
b. subdividing each said front and said back faces of said rectangularly shaped member into twelve equal squares arranged in four vertical rows and three horizontal rows; said four vertical rows being arranged as first, second, third, and fourth rows respectively, partitioned by said first, second, and third fold lines and positioned consecutively from one vertical edge of said member to an opposite vertical edged thereof; said horizontal rows being arranged in a top, a center, and a bottom row;
c. cutting along a center portion of said third vertical fold line between center squares of said third vertical row and said fourth vertical row;
d. cutting along a horizontal line between said top and center squares of a second and third vertical row;
e. cutting along a horizontal line between said center squares and bottom squares of said second and said third vertical rows wherein steps c, d and e form a flap hinged along said first vertical fold line;
f. folding said flap of said center squares against the back face of a center square of said first vertical row and over said front face of said center square of said first vertical row;
g. folding said back face of said fourth vertical row against said back face of said third vertical row;
h. folding said front face of said fourth vertical row against said back face of said second vertical row; and adhering together said center square of said first vertical row to said center square of said fourth vertical row.

* * * * *